US008436552B2

(12) United States Patent
Komagata et al.

(10) Patent No.: US 8,436,552 B2
(45) Date of Patent: May 7, 2013

(54) POWER SOURCE CONTROL DEVICE OF ILLUMINATOR AND LIGHTING SYSTEM

(75) Inventors: Masaaki Komagata, Tama (JP); Noboru Sugie, Tama (JP); Ryoji Waki, Tama (JP); Shinichi Goto, Tama (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 265 days.

(21) Appl. No.: 13/036,220

(22) Filed: Feb. 28, 2011

(65) Prior Publication Data

US 2011/0291586 A1 Dec. 1, 2011

(30) Foreign Application Priority Data

May 25, 2010 (JP) ..... 2010-119028

(51) Int. Cl.
*H05B 37/02* (2006.01)

(52) U.S. Cl.
USPC ..... 315/291; 315/307; 315/312; 315/318; 315/360

(58) Field of Classification Search ..... 315/291, 315/294, 297, 307, 308, 312, 316, 318, 324, 315/360
See application file for complete search history.

(56) References Cited

U.S. PATENT DOCUMENTS

| | | | | |
|---|---|---|---|---|
| 4,529,980 | A * | 7/1985 | Liotine et al. | 340/9.16 |
| 4,750,118 | A | 6/1988 | Heitschel et al. | |
| 5,352,957 | A * | 10/1994 | Werner | 315/291 |
| 5,907,279 | A | 5/1999 | Bruins et al. | |
| 6,300,727 | B1 * | 10/2001 | Bryde et al. | 315/294 |
| 6,348,768 | B1 * | 2/2002 | Weng | 315/292 |
| 6,759,966 | B1 * | 7/2004 | Weng | 340/9.1 |
| 7,355,523 | B2 * | 4/2008 | Sid | 340/9.16 |
| 8,258,721 | B2 * | 9/2012 | Meyer | 315/294 |
| 8,294,379 | B2 * | 10/2012 | Liu et al. | 315/224 |
| 2007/0081346 | A1 | 4/2007 | Spinello | |
| 2007/0139316 | A1 | 6/2007 | Hyatt | |

FOREIGN PATENT DOCUMENTS

| | | | |
|---|---|---|---|
| GB | 2 336 045 | A | 10/1999 |
| JP | 2009-301876 | A | 12/2009 |
| WO | WO 97/29465 | A1 | 8/1997 |
| WO | WO 2004/103029 | A1 | 11/2004 |
| WO | WO 2009/017353 | A2 | 2/2009 |

OTHER PUBLICATIONS

Partial European Search Report (PESR) dated Aug. 5, 2011 (in English) in counterpart European Application No. 11163137.0.
Extended European Search Report (EESR) dated Jan. 30, 2012 (in English) in counterpart European Application No. 11163137.0.

* cited by examiner

*Primary Examiner* — Tung X Le
(74) *Attorney, Agent, or Firm* — Holtz, Holtz, Goodman & Chick, P.C.

(57) ABSTRACT

A power source control device for controlling an illuminance of an illuminator by outputting a current for driving the illuminator and by controlling the current, including: a receiver for receiving a wireless signal having a predetermined frequency; a storage section for storing a setting table holding a first code indicating a predetermined device identification code; a control signal generating circuit for comparing a second code included in the wireless signal with the first code to output a control signal when the second code agrees with the first code; and a current outputting circuit for generating and outputting a current according to the control signal generating circuit, wherein the power source control device controls the illuminance of the illuminator according to the wireless signal from a desired wireless signal transmitting device in response to a change of the first coded held in the setting table.

9 Claims, 13 Drawing Sheets

POWER SOURCE CONTROL DEVICE OF ILLUMINATOR AND LIGHTING SYSTEM

BACKGROUND OF THE INVENTION

1. Field of the Invention

The present invention relates to a power source control device of an illuminator and a power source control device for controlling the lighting, the extinction, and the dimming of a light emitting diode (LED) lighting, and more particularly to a power source control device performing a dimming control of LED lighting by the use of a remote control device and a lighting system using the power source control device.

2. Description of Related Art

In recent years, LED lighting consuming little electric power has become widely used in place of incandescent lamps consuming much electric power in order to decrease the amount of the emission of carbon dioxide. A technique for controlling the dimming of such an LED illuminating device on the basis of a first dimming signal composed of a pulse signal the duty or the frequency of which can be changed and a second dimming signal composed of a pulse signal the voltage amplitude of which can be changed was proposed (Japanese Patent Application Laid-Open Publication No. 2009-301876).

The dimming control technique described in Japanese Patent Application Laid-Open Publication No. 2009-301876 has a problem in which changes after laying are troublesome because the technique adopts a wired system. To put it concretely, when a plurality of illuminators is laid on a ceiling of a comparatively wide building, the illuminators are sometimes attached to the ceiling at predetermined intervals. When a lighting system for controlling the dimming of the plurality of illuminators is built, a plurality of power switches SW1, SW2, . . . and dimming dials DL1, DL2, are generally provided as shown in FIG. 13. Although FIG. 13 shows that one illuminator LED is connected to a set of a switch and a dimming dial, a plurality of illuminators is actually connected to a set of a switch and a dimming dial.

There is, however, the case of changing (increasing or decreasing) the number of previously installed illuminators LED as shown in FIG. 12A or the case of extension or the case of changing the combination of illuminators LED controlled by power switches SW and dimming dials DL as shown in FIG. 12B with the reconstruction of the building, a change of interior finishing, and the like. However, the larger the number of illuminators laid in a building, which is large, is, the more the number of wires becomes. Consequently, a lighting system to which the conventional technique is applied has a problem in which the construction of increasing wires and switches, increasing and changing switching relays, and the like becomes complicated and massive.

In addition, there are some difficult cases of construction such as the increasing, the changing, and the like of illuminators in the cases of facilities having high ceilings, such as warehouses and exhibit halls, facilities having inferior construction environments, such as refrigerating rooms, buildings having narrow spaces for wiring owing to their structures, and the like. The illuminators LED in FIGS. 12A and 12B are those in each of which a lamp and a power source unit (including a driver) are integrated.

SUMMARY OF THE INVENTION

The present invention was made by regarding the problem describe above, and aims at enabling increasing and changing illuminators comparatively easily in a lighting system equipped with a plurality of illuminators and configured to be able to perform a dimming control.

In order to attain the object mentioned above, according to a first aspect of the present invention, a power source control device for controlling an illuminance of an illuminator by outputting a current for driving the illuminator and by controlling the current includes: a receiver for receiving a wireless signal having a predetermined frequency; a rewritable storage section for storing a setting table holding a first code indicating a predetermined device identification code; a control signal generating circuit for comparing a second code included in the wireless signal received by the receiver with the first code held in the setting table to output a control signal when the second code agrees with the first code; and a current outputting circuit for generating and outputting a current according to the control signal from the control signal generating circuit, wherein the power source control device is configured to control the illuminance of the illuminator according to the wireless signal from a desired wireless signal transmitting device by setting a device identification code of the desired wireless signal transmitting device as the first code in the setting table.

The setting table is, preferably, configured to be able to hold a plurality of the first codes to control the illuminance of the illuminator according to wireless signals from a plurality of the wireless signal transmitting devices corresponding to the first codes held in the setting table, respectively here. The combination of illuminators controlled by the plurality of wireless signal transmitting devices (wireless switches) can, hereby, be set freely.

In addition, the setting table is, preferably, configured to be able to hold a third code indicating a function code specifying how to change the current to be output by the current outputting circuit besides the first code, and the control signal generating circuit is configured to compare the second code included in the wireless signal received by the receiver with the first code held in the setting table to output a control signal corresponding to the third code held in the setting table when the second code agrees with the first code. The changing way of the illuminance to an operation of the wireless signal transmitting device (wireless switch) can hereby be changed to each illuminator to be controlled.

Furthermore, the setting table is, preferably, configured to be able to hold a plurality of third codes each indicating function code specifying how to change the current to be output by the current outputting circuit correspondingly to each of the plurality of first codes, and the control signal generating circuit is configured to output the control signal corresponding to one of the third codes held in the setting table correspondingly to a first code agreeing with the second code included in the wireless signal received by the receiver.

Furthermore, the first code preferably includes a first device identification code for identifying a wireless signal transmitting device having a first function and a second device identification code for identifying a wireless signal transmitting device having a second function, and the control signal generating circuit compares the second code included in the wireless signal received by the receiver with the first code held in the setting table to cause the rewritable storage section to be shifted to a state where the first code held in the setting table to be rewritable when the second code agrees with the second device identification code.

In addition, according to a second aspect of the present invention, a lighting system includes: the power source control device having the configuration mentioned above; an illuminator driven to be lighted by the power source control device; and a wireless signal transmitting device including a switch button and an energy self-feeding device converting an operating force of the switch button into electric energy, wherein the wireless signal transmitting device is configured to include a storage section to store its own device identification code as the second code, and a transmitter capable of transmitting a wireless signal of a predetermined frequency, and to transmit the wireless signal including the second code when the switch button is operated.

The lighting system, preferably, further includes here: a second function wireless signal transmitting device including a key input section, a storage section to store its own device identification code as the second code and a function code instructing to rewrite the setting table as the third code, and a transmitter capable of transmitting a wireless signal of a predetermined frequency, wherein the second function wireless signal transmitting device is configured to transmit a wireless signal including the second code and the third code when the key input section is operated.

Furthermore, the second function wireless signal transmitting device is, preferably, configured to be able to transmit a wireless signal including the second code indicating a device identification code specifying a power source control device to operate in response to the third code included in the wireless signal transmitted by the transmitter. It hereby becomes possible to specify only the power source control device (LED power source unit) desired to change its setting table to simply change the set mode thereof.

In addition, according to a third aspect of the present invention, a lighting system includes: the power source control device having the configuration described above; an illuminator driven to be lighted by the power source control device; and a wireless signal transmitting device including an input section, a storage section, a transmitter capable of transmitting a wireless signal of a predetermined frequency, and a control section to operate in conformity with a program stored in the storage section and control the transmitter according to an input from the input section, wherein the control section is configured to include a device identification code generating function of sequentially generating the second code indicating a device identification code given to each power source control device and a transmission function of making the transmitter transmit the generated second codes and a command code for instructing lighting or flickering.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, suitable embodiments of the present invention will be described with reference to the accompanying drawings.

Figure 1:
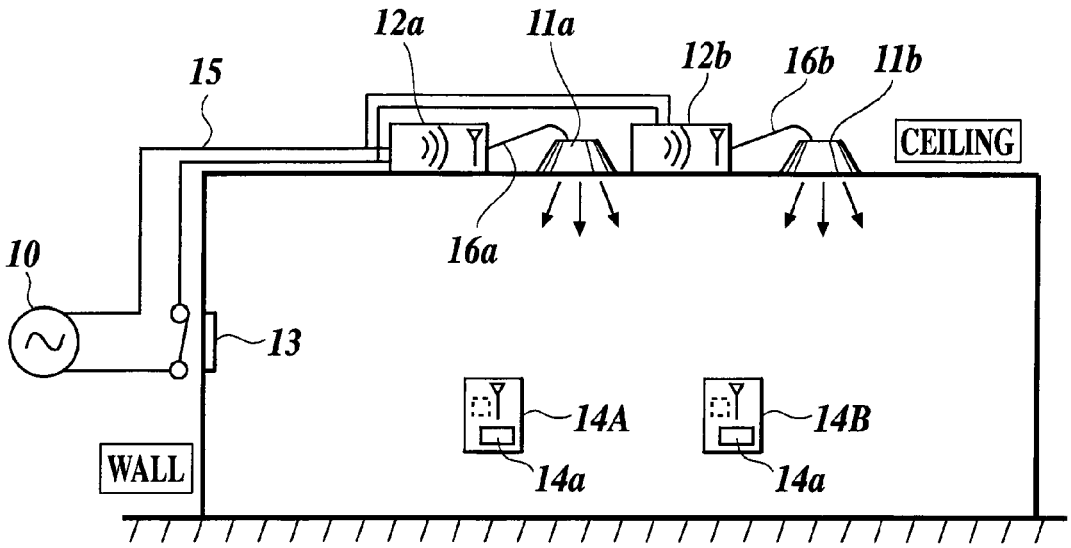
FIG. 1 is a schematic configuration diagram showing a first embodiment of a lighting system to which the present invention is applied.

FIG. 1 shows a first embodiment of a lighting system according to the present invention which lighting system uses a plurality of LED lamps and controls the LED lamps with wireless switches.

The lighting system of the present embodiment is, as shown in FIG. 1, equipped with LED lamps 11*a*, 11*b*, . . . attached on a ceiling of a building downward as illuminators; LED power source units 12*a*, 12*b*, . . . provided to the LED lamps 11*a*, 11*b*, . . . , respectively, as power source control devices supplying power source voltages to the respective LED lamps 11*a*, 11*b*, . . . ; a main power switch 13 for turning on and off the power sources of the whole lighting system; and wireless switches 14A, 14B, . . . transmitting wireless signals for dimming controls to the LED power source units 12*a*, 12*b*, . . . , respectively.

Power source wiring 15 for supplying an alternating current (AC) power source voltage from a common AC power source 10 to the LED power source units 12*a*, 12*b*, . . . is, then, laid from the inside of a wall of the building to the ceiling thereof. The LED lamps 11*a*, 11*b*, . . . are connected to the corresponding LED power source units 12*a*, 12*b*, . . . , respectively, with cables 16*a*, 16*b*, . . . , respectively. The main power switch 13 can be omitted.

Each of the wireless switches 14A, 14B, . . . is a kind of remote control device, and is equipped with a switch button 14*a* on the surface of a case of a portable size (palm size), an electromechanical transducer, such as a dynamo, generating electric power by using the movement caused by an operation of the switch button 14*a*, and a transmitter outputting a wireless signal (electric wave) of, e.g. 2.4 GHz, both of the electromechanical transducer and the transmitter incorporated in an inside of each of the wireless switches 14A, 14B, . . . . Because electromechanical transducers having various configurations have conventionally been known as those having such a structure and a function and being of a type of energy self-feeding system needing no batteries to be used for wireless switches, their detailed descriptions are omitted.

In addition, a peculiar device identification code (hereinafter referred to as ID code) is given to each of the wireless switches 14A, 14B, . . . used for the lighting system of the present embodiment, and each of the wireless switches 14A, 14B, . . . is configured to transmit a wireless signal together with the given ID code. To put it concretely, a carrier wave of a predetermined frequency (as the wireless signal) can be subjected to an amplitude modulation or a frequency modulation (expressing the ID code) to be transmitted.

Figure 10A:
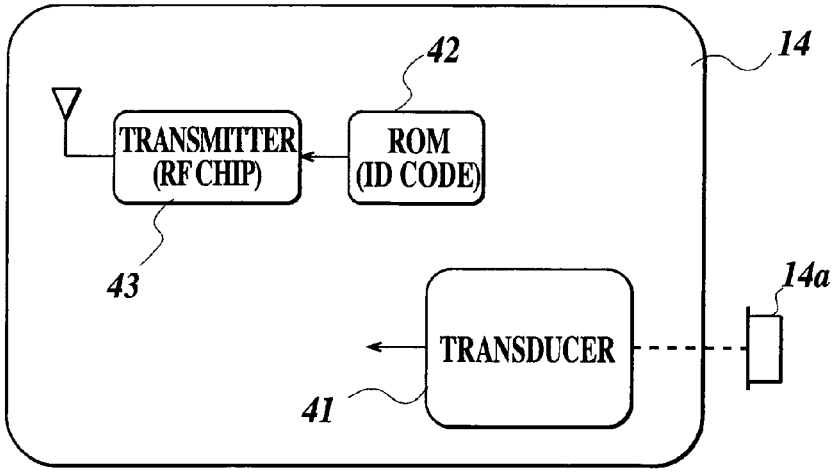
FIG. 10A is a block diagram showing a circuit configuration example of a wireless switch used in the first embodiment and the second embodiment of the present invention.

Each of the wireless switches 14A, 14B, . . . (hereinafter referred to as a wireless switch 14 representatively) is, as shown in FIG. 10A, equipped with an electromechanical transducer 41 generating electric power, a read only memory (ROM) 42 storing an ID code in a nonvolatile manner, and a transmitter 43 transmitting the ID code. On the other hand, the LED power source units 12*a*, 12*b*, . . . receiving wireless signals from the wireless switches 14A, 14B, . . . , respectively, are each provided with the function of recognizing the ID code from a previously associated wireless switch, and are each configured to execute a dimming control of the LED lamp under its own control when each of the LED power source units 12*a*, 12*b*, . . . (hereinafter referred to as an LED power source unit 12 representatively) receives a wireless signal from the predetermined wireless switch.

Figure 2:
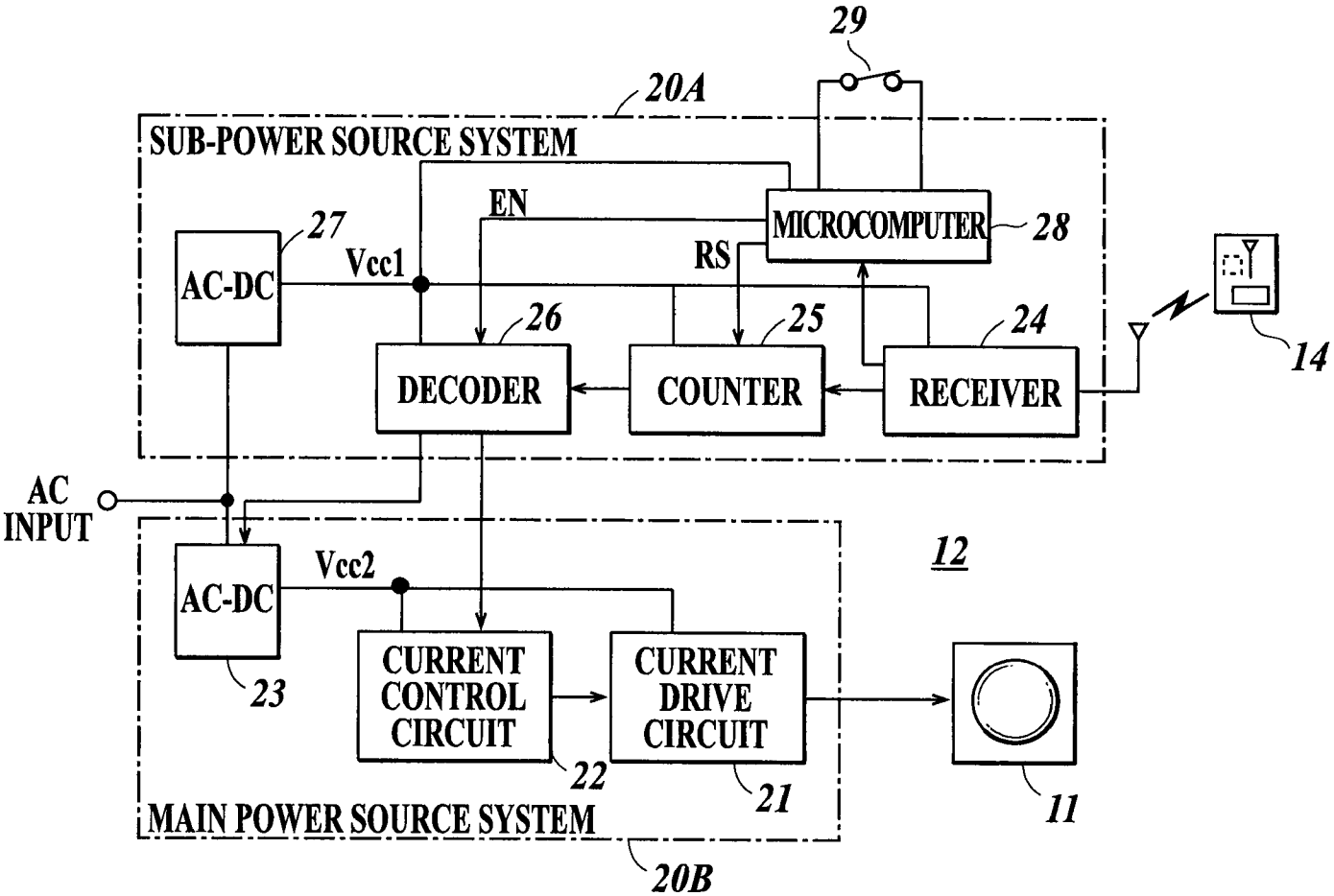
FIG. 2 is a block diagram showing a circuit configuration example of a power source control device (power source unit) of an LED lamp in the lighting system of the first embodiment.

FIG. 2 shows a configuration example of the LED power source unit 12 constituting the lighting system of the present embodiment.

The LED power source unit 12 of FIG. 2 is equipped with a current drive circuit (current source) 21 outputting a drive current for driving each of the LED lamps 11*a*, 11*b*, . . . (hereinafter referred to as an LED lamp 11 representatively) by a constant current, a current control circuit 22 controlling the current drive circuit 21 to change the magnitude of the current made to flow through the LED lamp 11, and an alternating current to direct current (AC-DC) converter circuit 23, as a main power source, receiving the AC power source voltage to generate a direct-current (DC) power source voltage Vcc2 necessary for the operations of the current drive circuit 21 and the current control circuit 22.

In addition, the LED power source unit 12 is equipped with a receiver 24 receiving a wireless signal from the wireless switch 14, a counter circuit 25 counting a pulse signal from the receiver 24, a decoder circuit 26 decoding an output (counted value) from the counter circuit 25, an AC-DC converter circuit 27, as a sub-power source, receiving the AC power source voltage to generate a DC power source voltage Vcc1 necessary for the operations of the receiver 24, the counter circuit 25, and the decoder circuit 26, a microcomputer 28 having the function of decoding a signal (ID code) from the wireless switch 14 to control the circuits in the LED power source unit 12, such as the counter circuit 25 and the decoder circuit 26, and a setting switch 29 provided on the surface of the main body case of the LED power source unit 12.

The microcomputer 28 incorporates a memory storing the ID coded of the previously associated wireless switch 14. The microcomputer 28 is configured to receive a wireless signal (ID code) from the wireless switch 14 with the receiver 24, and then to compare the received ID code and the self-storing ID code. The microcomputer 28 is configured to output an enable signal (operation permission signal) EN to the decoder circuit 26 when the received ID code agrees with the self-storing ID code.

In addition, the receiver 24 is configured to output one-shot pulse signal when the receiver 24 receives the wireless signal from the wireless switch 14. The counter circuit 25 is composed of, for example, three bits, and counts up the counted value thereof by one every reception of an ID code with the receiver 24 to count eight pulses at the maximum. The decoder circuit 26 is then configured to decode the counted value of the counter circuit 25 to output a current control signal when the enable signal EN is input from the microcomputer 28. In addition, the counter circuit 25 is configured to be resettable by the microcomputer 28.

The AC-DC converter circuit 27, as the sub-power source, generating the DC power source voltage Vcc1 necessary for the operations of the receiver 24, the counter circuit 25, and the decoder circuit 26, always converts an AC voltage into a DC voltage. On the other hand, the AC-DC converter circuit 23, as the main power source, generating the DC power source voltage Vcc2 necessary for the operations of the current drive circuit 21 and the current control circuit 22, is configured to stop the operation of converting the AC voltage to the DC voltage during an extinction of the LED lamp 11.

To put it concretely, for example, when a wireless signal is input from the corresponding wireless switch 14 into the receiver 24 during un-lighting of the LED lamp 11, the AC-DC converter circuit 23, as the main power source, is activated, and the current drive circuit 21 and the current control circuit 22 become operable. In addition, the AC-DC converter circuit 23, as the main power source, is configured to turn off when the drive current output from the current control circuit 22 becomes zero and the LED lamp 11 is switched to its extinction state. The main power source turns off during the extinction of the LED lamp 11 as described above, and the LED power source unit 12 is thereby configured to consume little electric power (standby power).

The detailed operations (dimming controls) of the receiver 24, the microcomputer 28, the counter circuit 25, and the decoder circuit 26 of the sub-power source system circuit 20A, which is operated by the sub-power source, will next, be described. As a dimming control realizable by the power source unit 12 having the configuration of FIG. 2, the systems described in the following are conceivable.

A first control system is a control system for counting up the counted value of the counter circuit 25 every reception of a wireless signal from the wireless switch 14 with the receiver 24 to change the brightness of the LED lamp 11 according to the counted value. In addition, a second control system is a control system in which the LED lamp 11 is composed of an illuminator incorporating therein three LEDs of red one, blue one, and green one, and counting up the counted value of the counter circuit 25 every reception of a wireless signal from the wireless switch 14 with the receiver 24 to change the luminous color of the LED lamp 11 according to the counted value.

Figure 3:
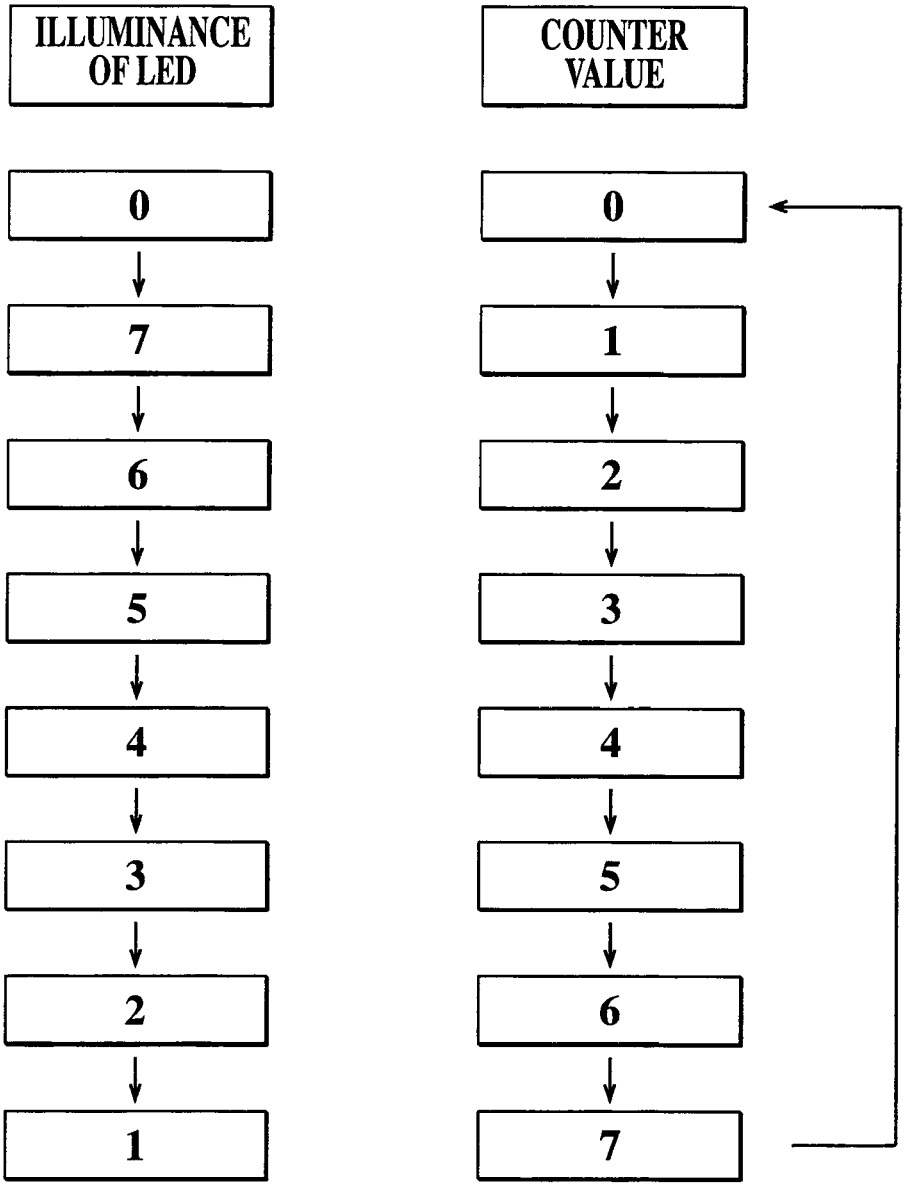
FIG. 3 is an explanatory diagram showing a relation between counted values (counter values) of a counter circuit and the illuminances of an LED at the time of performing a control of changing the illuminance of the LED lamp by a first control system in the lighting system of the first embodiment.

FIG. 3 shows a relation between the counted values (counter values) of the counter circuit 25 and the illuminances of the LED lamp 11 at the time of performing the control of changing the brightness, i.e. the illuminance, of the LED lamp 11 by the first control system. In FIG. 3, it is shown that the larger the values of the numerals of from "1" to "7," indicating the illuminances, are, the brighter the illuminances are, and vice versa, and that the numeral "0" indicates an extinction state. The larger the current flowing through the LED lamp 11 is, the more the LED lamp 11 emits light brightly, here. Consequently, it is indicated that the larger the values of the numerals in FIG. 3, expressing the illuminances, the larger LED drive currents the current drive circuit 21 outputs.

In the control system of FIG. 3, the counted values of the counter circuit 25 and the values indicating the illuminances change conversely to each other. That is, as the counted value of the counter circuit 25 increases from "1" in order, the output current of the current drive circuit 21 decreases, and the illuminance of the LED lamp 11 diminishes from "7" in order. In addition, when a wireless signal is input from the wireless switch 14 in the state in which the counted value of the counter circuit 25 is "7" (the LED illuminance is "1"), the counted value returns to "0," and the LED lamp 11 is controlled to be the extinction state. A down-counter can be used as the counter circuit 25 in place of the up-counter.

For example, if the wireless switch 14A is associated to the LED power source unit 12*a* by means of an ID code by applying the first control system to the lighting system of FIG. 1, when the wireless switch 14A is operated, the wireless signal from the wireless switch 14A is received by the LED power source units 12*a*, 12*b*, . . . of the plurality of LED lamps 11*a*, 11*b*, . . . at the same time, and only the counter circuit 25 and the decoder circuit 26 of the LED power source unit 12*a*, associated to the wireless switch 14A among the LED power source units 12*a*, 12*b*, . . . , operate. The illuminance of the LED lamp 11*a*, connected to the LED power source unit 12*a*, is thereby controlled to change.

According to the configuration of FIG. 3, when a first wireless signal is input from the wireless switch 14 into the corresponding LED power source unit 12, the corresponding LED lamp 11 is lighted at the highest illuminance thereof, and after that, the illuminance of the LED lamp 11 is controlled to lower by a step every input of the wireless signal. Also in a control of changing the luminous color of the LED lamp 11 in the second control system, the LED power source unit 12 changing the luminous color of the LED lamp 11 in response to a wireless signal from the corresponding wireless switch 14 can be realized by performing a suitable design change of the decoder circuit 26 of FIG. 2.

A change of the set mode, i.e. a change of the association (pairing) between the wireless switch 14 and the LED power source unit 12, will next be described.

When the setting switch 29, provided on the surface of the case of the LED power source unit 12, is turned on, the microcomputer 28 in the LED power source unit 12 of the present embodiment shifts its state from a controlling state to a setting state, and to replace the ID code received by the receiver 24 during the setting state with an ID code stored in the memory (SW table) of the microcomputer 28 until then or add the ID code received by the receiver 24 into the memory to be stored therein.

It is consequently possible to change the association (pairing) of the LED lamp 11 controlled by the predetermined wireless switch 14 by rewriting the ID code of the wireless switch 14 stored in the LED power source unit 12 the setting of the association of which is desired to be changed even in an already laid lighting system. In addition, even in the case of increasing the LED lamp 11, if the setting switch 29 is operated to be turned on and the wireless switch 14 associated to the LED lamp 11 desired to be simultaneously subjected to a dimming control among the already laid LED lamps 11 is operated to transmit an wireless signal (ID code) therefrom to the LED power source unit 12, then the microcomputer 28 in the LED power source unit 12 rewrites the ID code of the internal memory (SW table) thereof, or additionally or newly registers the transmitted ID code.

Figure 4B:
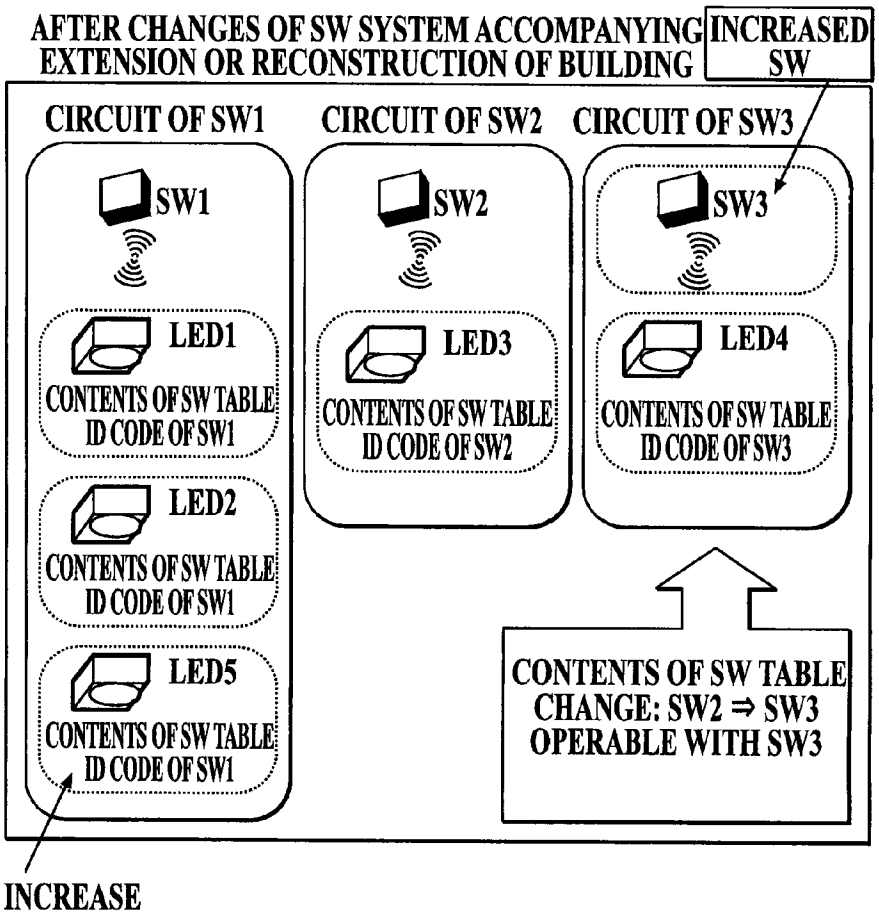
FIGS. 4A and 4B are explanatory diagrams showing changes of group configurations at the time of changing the settings of LED lamps subjected to diming controls with a plurality of wireless switches in the lighting system of the first embodiment.
Figure 4A:
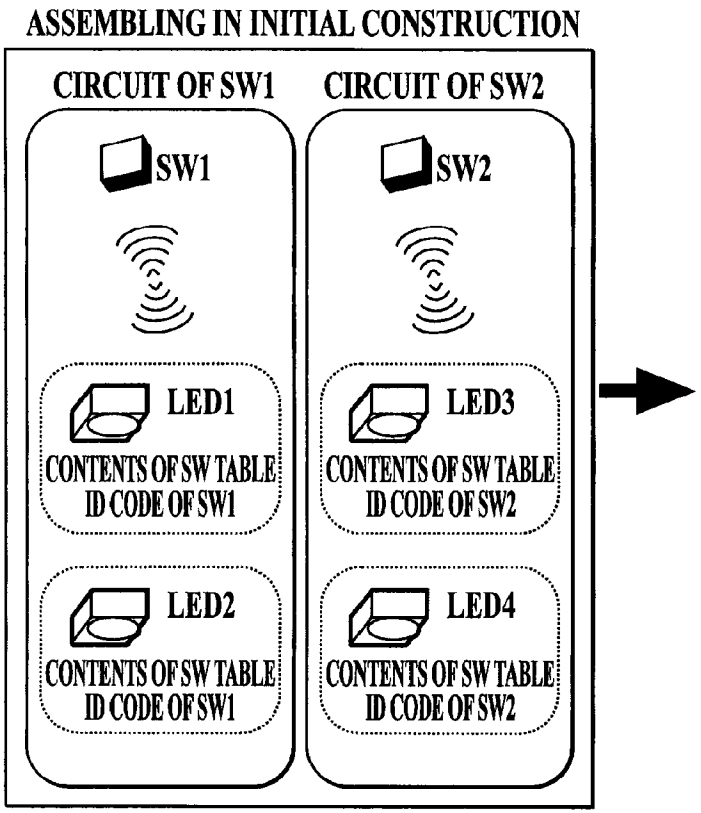

Accordingly, after that, the microcomputer 28 performs the dimming controls of the LED lamps 11 under its control only at the time of an operation of the wireless switch 14 having the ID code resisted in the SW table, and consequently a lighting system set to perform the dimming controls of an LED 1 and an LED 2 with a wireless switch SW1 and the dimming controls of an LED 3 and an LED 4 with a wireless switch SW2, for example, as shown in FIGS. 4A and 4B, can be changed to a lighting system set to perform the dimming controls of the LED 1, the LED 2, and an LED 5 with the wireless switch SW1, the dimming control of the LED 3 with the wireless switch SW2, and the dimming control of the LED 4 with a wireless switch SW3.

Figure 5A:
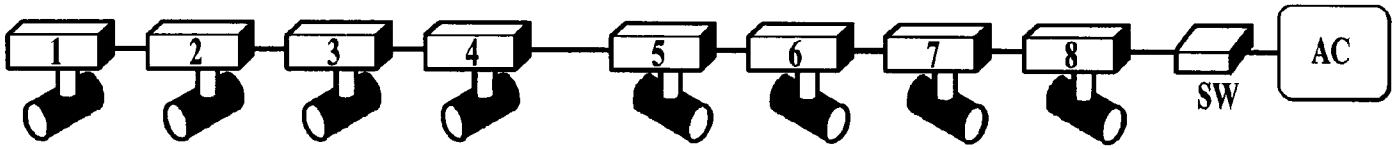
FIG. 5A is an explanatory diagram showing an arrangement example of LED lamps in the lighting system of the first embodiment using conventional spotlights.
Figure 5B:
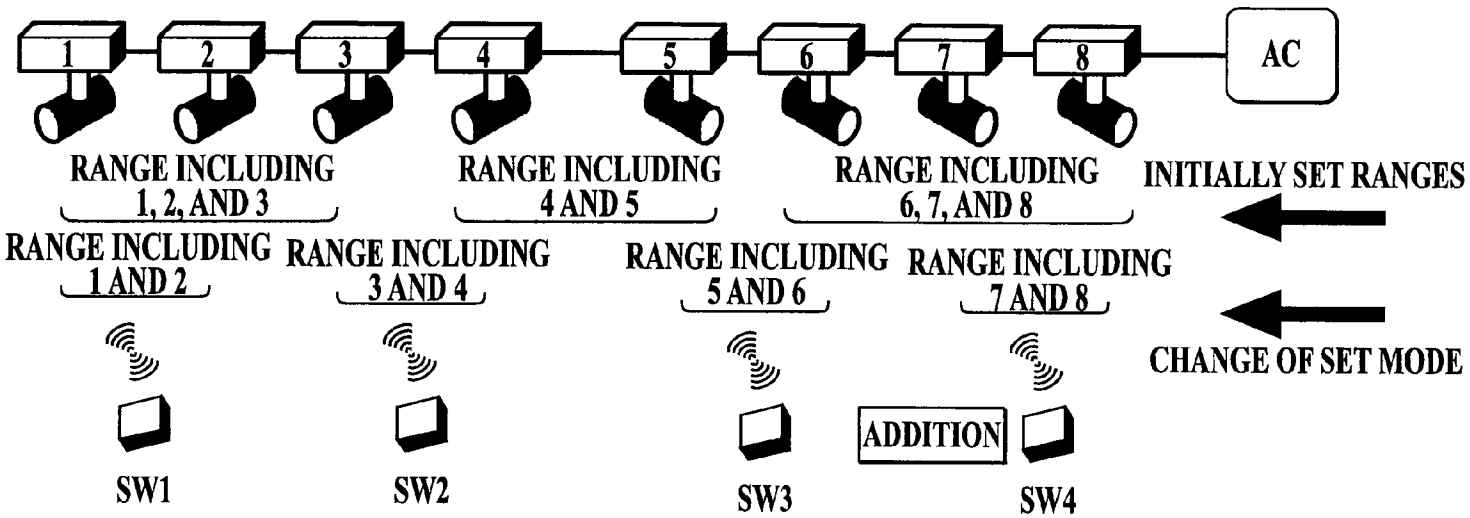
FIG. 5B is an explanatory diagram showing changes of group configurations at the time of changing the settings of LED lamps by applying the first embodiment to the lighting system using the spotlights.

In addition, in a lighting system in which a power source voltage is supplied to a plurality of spotlights attached to one rail as shown in FIG. 5A, which system is often used in a sale room of goods such as clothing items, an event site, and the like, it has conventionally been impossible to perform the independent dimming controls of the plurality of illuminators installed on the same rail. By applying the embodiment described above, however, a lighting system set to divide lamps 1-8 into groups of the lamps 1, 2, and 3, the lamps 4 and 5, and the lamps 6, 7, and 8 in initial setting as shown in FIG. 5B can be rebuilt as a lighting system dividing the lamps 1-8 into groups of, for example, the lamps 1 and 2, the lamps 3 and 4, the lamps 5 and 6, and the lamps 7 and 8 by a change of the set mode.

(First Modification)

A first modification of the LED power source unit 12 constituting the lighting system of the embodiment described above will next be described. The first modification is configured in order to enable the memory (SW table) in the microcomputer 28 of the LED power source unit 12 in the embodiment of FIG. 2 to set the ID codes of a plurality of wireless switches 14, and in order to enable the microcomputer 28 to perform a dimming control when a received ID code agrees with any ID code set in the memory (SW table).

Figure 6:
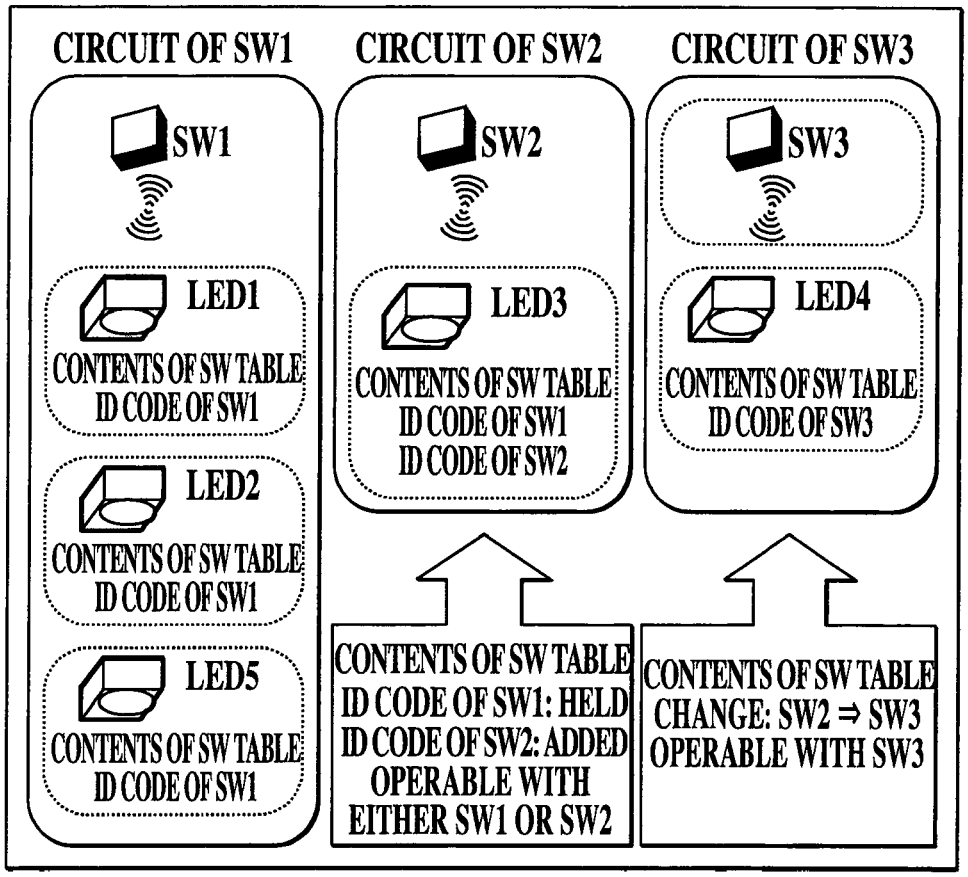
FIG. 6 is an explanatory diagram showing a setting example of LED lamps subjected to diming controls by a plurality of wireless switches in a lighting system of a first modification of the first embodiment.

According to this modification, for example, as shown in FIG. 6, by storing the ID codes of the wireless switches SW1 and SW2 in the memory (SW table) in the power source unit 12 of the lamp LED 4, a lighting system in which the lamp LED 4 is subjected to a dimming control by either an operation of the wireless switch SW1 or an operation of the wireless switch SW2 can be realized.

(Second Modification)

Figure 7:
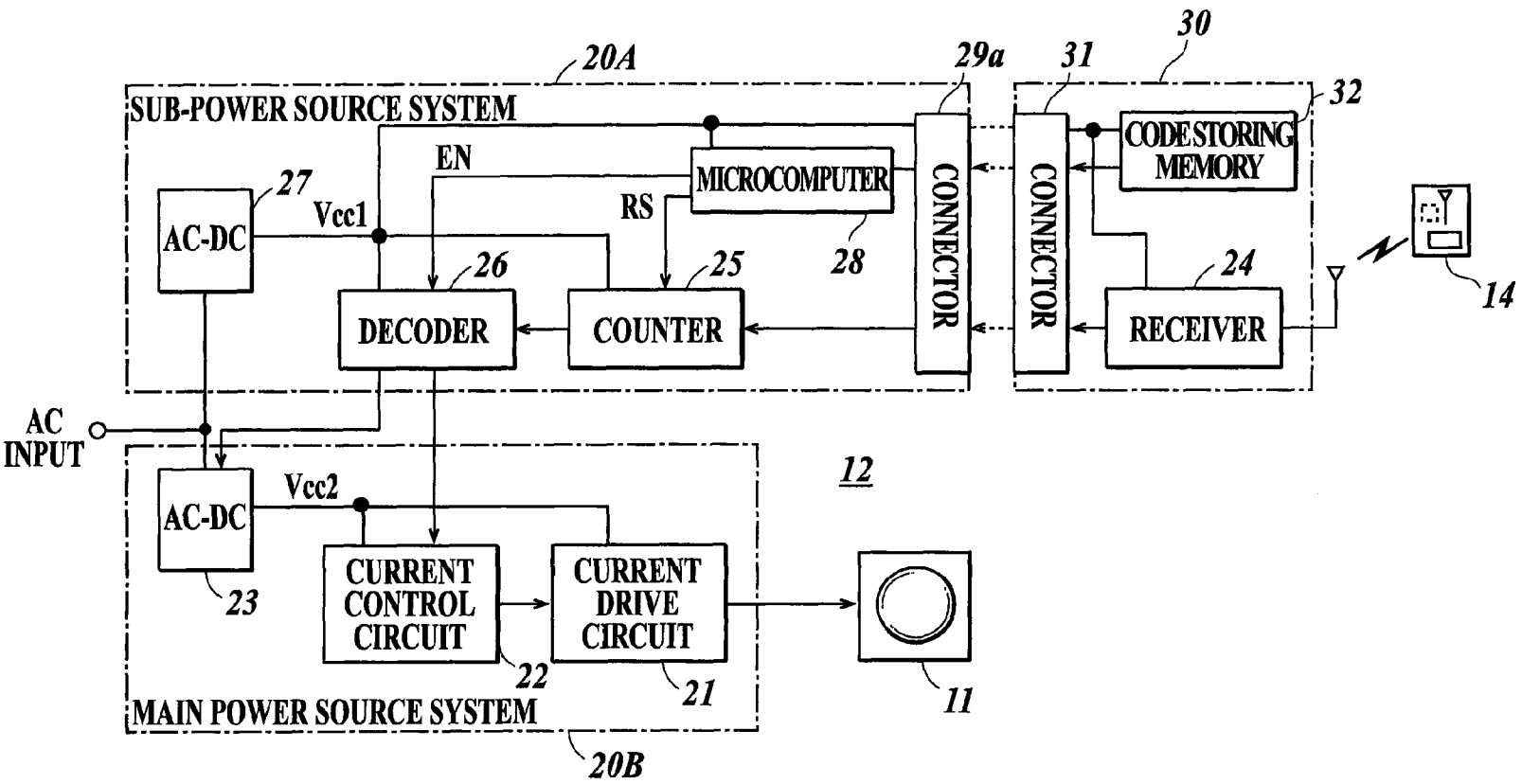
FIG. 7 is a block diagram showing a circuit configuration example of a power source control device of an LED lamp in a second modification of the first embodiment.

A second modification of the LED power source unit 12 constituting the lighting system of the embodiment will next be described. In the second modification, a connector 29*a* is provided in place of the provision of the setting switch 29 on the main body case of the LED power source unit 12 as shown in FIG. 7, and a receiver unit 30 incorporating the receiver 24 therein is prepared separately from the LED power source unit 12, which receiver unit 30 is provided with a connector 31 capable of being inserted into and removed from the connector 29*a* and a code storing memory (ROM) 32.

The ID code of the wireless switch 14 that is desired to be associated with the LED power source unit 12 is stored in the code storing memory 32. The microcomputer 28 is, then, configured in order that, when the receiver unit 30 is connected to the LED power source unit 12 with the connectors 31 and 29*a*, the microcomputer 28 may read out the ID code stored in the code storing memory 32 of the receiver unit 30. In this modification, a different wireless switch 14 can give a dimming control command to the LED power source unit 12 by inserting a different receiver unit 30 including the memory 32 storing a different ID code therein into the connector 29*a*.

The second modification consequently has an advantage that a change of a set mode can be performed more simply than the embodiment described above. In addition, although the embodiment described above needs to incorporate a backup battery into the LED power source unit 12 or to use the microcomputer 28 including a nonvolatile memory capable of rewriting data, such as a flash memory, in an inside of the microcomputer 28 in order to hold the ID code of the wireless switch 14 even if the power source voltage of the embodiment is broken, the present modification has the advantage of having no necessity of that kind.

In place of preparing the receiver unit 30 configured to incorporate the receiver 24 and the code storing memory 32 therein and to be capable of being inserted into or removed from the connector 29*a*, the LED power source unit 12 can incorporate the receiver 24 therein as it is, and can be configured to be provided with a memory card storing an ID code therein and being capable of being inserted into and removed from the connector 29*a*. The configuration of the receiver unit 30 incorporating the receiver 24 and the code storing memory 32 therein as the second modification, however, has the advantage of being able to easily deal with a change of the frequency of a wireless signal.

(Third Modification)

Figure 8:
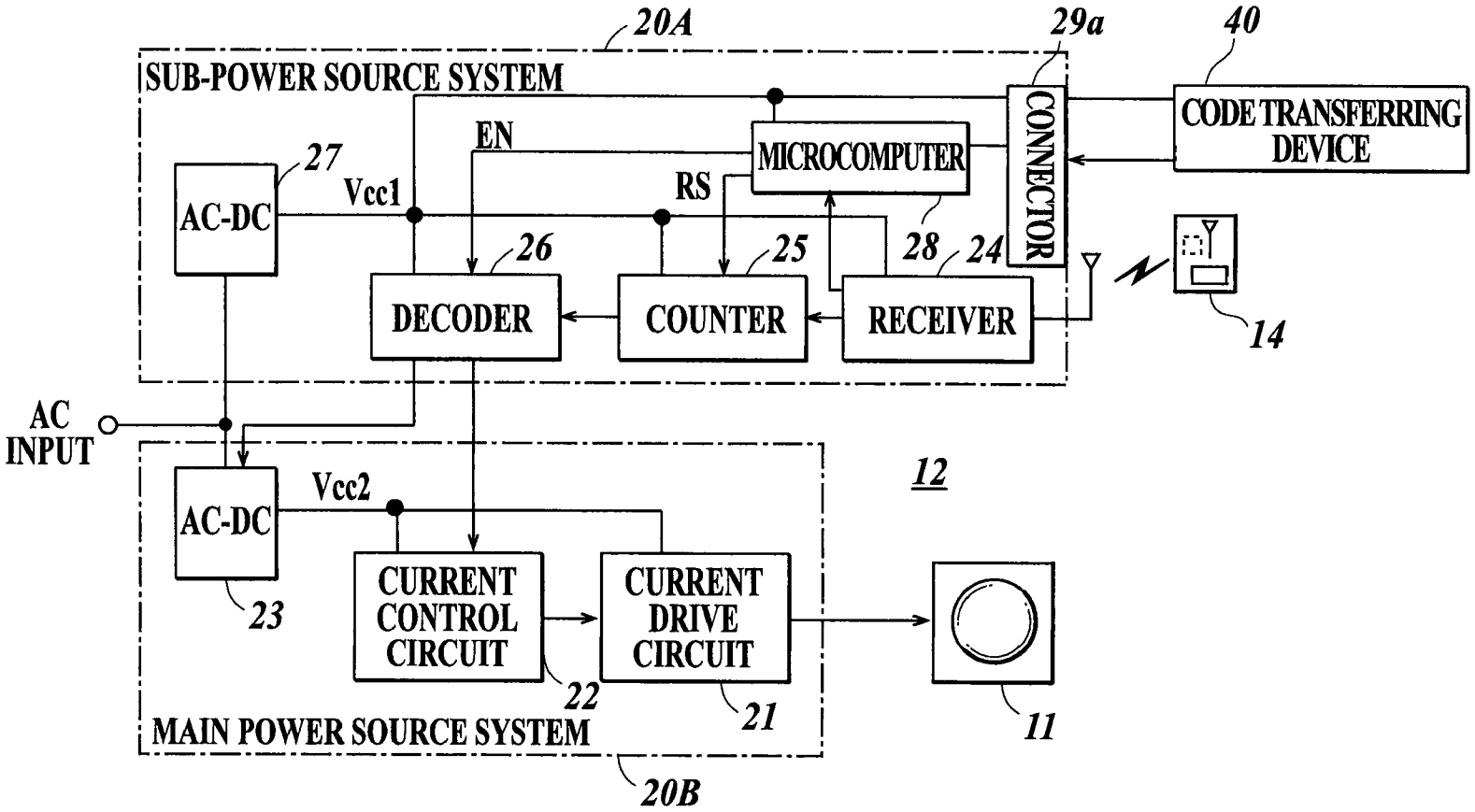
FIG. 8 is a block diagram showing a circuit configuration example of a power source control device of an LED lamp in a third modification of the first embodiment.

A third modification of the LED power source unit 12 constituting the lighting system of the embodiment described above will next be described. The third modification is, as shown in FIG. 8, also provided with the connector 29*a* in place of the setting switch 29 (FIG. 2) provided on the main body case of the LED power source unit 12, and a specialized data transferring device 40 prepared to be connected to the LED power source unit 12 through the connector 29*a*. The third modification is thus configured to be able to transfer the ID code of a desired wireless switch 14 to the microcomputer 28 by a wired system.

Also the third modification has the advantage that a change of a set mode can be performed more easily than the embodiment described above. In place of the configuration of connecting the specialized data transferring device 40 to the LED power source unit 12 though the connector 29*a*, a data setting remote controller of a wireless system can be prepared, and the lighting system can be configured to transmit the ID code of a desired wireless switch 14 to the microcomputer 28 through the receiver 24.

In this case, the remote controller is configured to transmit a peculiar ID code, and the microcomputer 28 of the LED power source unit 12 has only to be configured to be able to change the paring with the wireless switch 14 by storing the ID code of the remote controller in a rewritable nonvolatile memory, by shifting the state thereof to a setting state at the time of receiving an ID code of a remote controller, and by setting the ID code of the wireless switch 14 to be transmitted after that into the memory (SW table).

A second embodiment of a lighting system according to the present invention will next be described.

The lighting system of the second embodiment is configured as follows: in the LED power source unit 12 shown in FIG. 2, the memory (SW table) in the microcomputer 28 is made to be able to set a function code for specifying a control mode (such as the method of changing a current output by the current drive circuit 21) besides the ID code of a wireless switch 14 to be associated; and the microcomputer 28 performs a dimming control by outputting a predetermined control code to the decoder circuit 26 on the basis of the function code set in the SW table and the counted value of the counter circuit 25, and by decoding the control code with the decoder circuit 26 to output an LED current control signal.

Figure 9A:
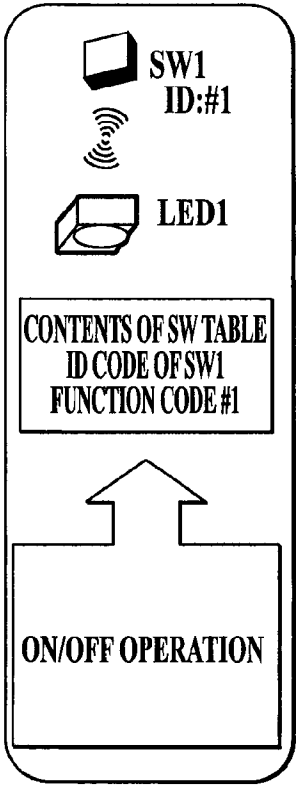
FIGS. 9A, 9B, 9C, and 9D are explanatory diagrams showing the relations between the function codes set in a setting table of a power source control device and the operations of the LED lamps subjected to dimming controls in the lighting system of a second embodiment.
Figure 9B:
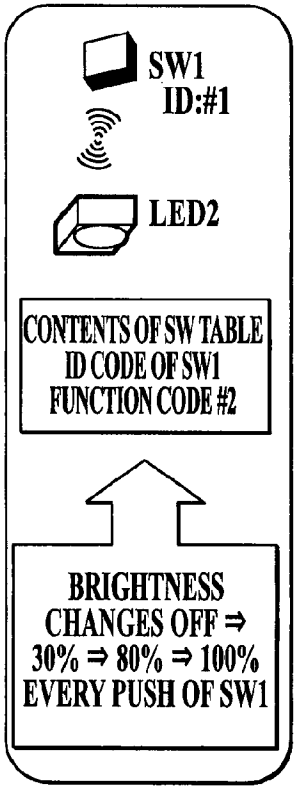
Figure 9C:
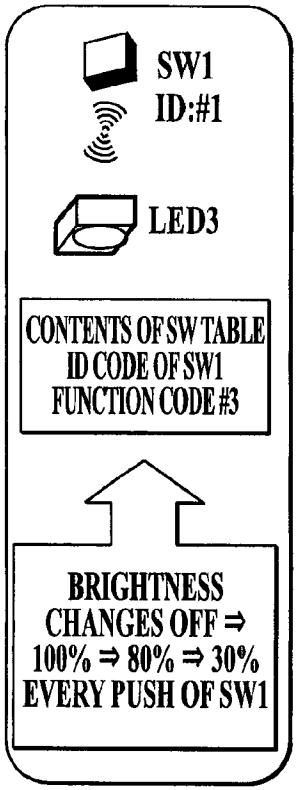

As the function code here, one of the following function codes, for example, as shown in FIGS. 9A-9C, can be used: a function code of specifying a control mode of alternately repeating the operations of turning on and off the LED lamp 11 every input of a wireless signal of the corresponding wireless switch 14 (function code #1), a function code of specifying a control mode of counting the wireless signals of the corresponding wireless switch 14 to gradually brightening the LED lamp 11, for example, in the way of OFF→30%→80%→100% according to the counted value (function code #2), and a function code of specifying a control mode of counting the wireless signals of the corresponding wireless switch 14 to gradually darkening the LED lamp 11, for example, in the way of 100%→80%→30%→OFF according to the counted value (function code #3).

Figure 9D:
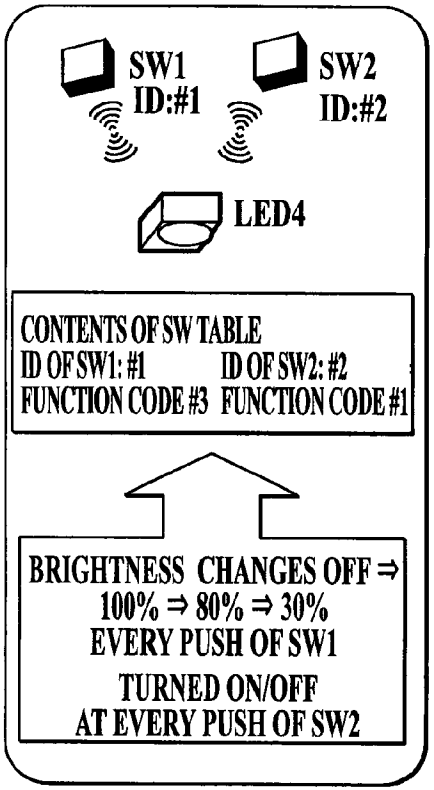

In addition, in the LED power source unit 12 of the embodiment, as shown in FIG. 9D, the microcomputer 28 is configured to be able to set the ID codes of a plurality of wireless switches 14 in the memory (SW table) of the microcomputer 28, and to set function codes to the respective registered ID codes. The LED power switch unit 12 can, hereby, operate the LED lamp 11 in such a manner that, for example, when the wireless switch SW1 of the ID code #1 is operated, the brightness of the LED lamp 11 stepwise changes, and when the wireless switch SW2 of the ID code #2 is operated, the LED lamp 11 repeats the on/off operations thereof.

As the function code, in addition to the function codes mentioned above, one of the following function codes can be provided: a function code of specifying a control mode of counting the wireless signals of the corresponding wireless switch 14 and changing the luminous color of the LED lamp 11 according to the counted value, a function code of changing the brightness of the LED lamp 11 by four or five steps besides the function codes #2 and #3, changing the brightness of the LED lamp 11 by three steps, a function code of specifying a control mode of flickering the LED lamp 11, and the like.

The setting (a change of a set mode) of the ID code and the function code of the wireless switch 14 to the memory (SW table) in the microcomputer 28 or the receiver unit 30 in the present embodiment can be made to perform by using, for example, a remote controller 50.

Figure 10B:
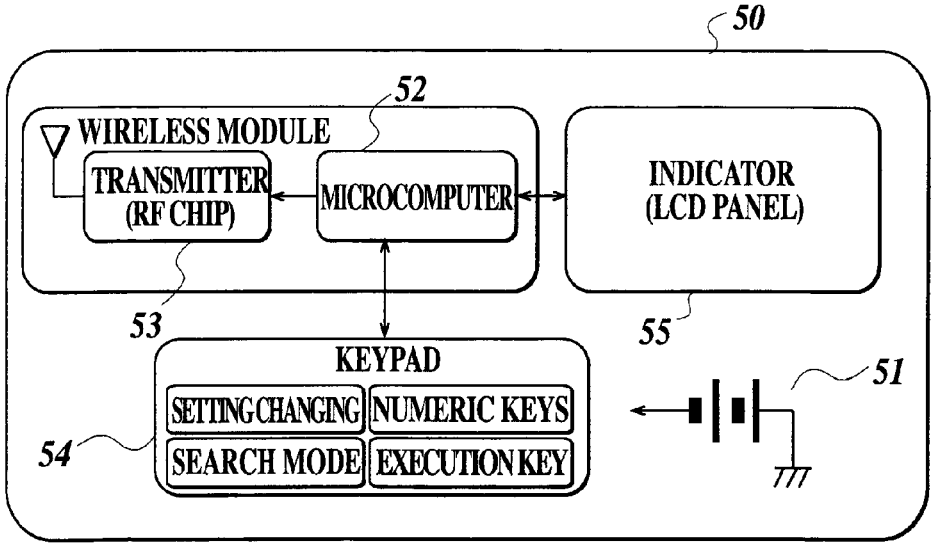
FIG. 10B is a block diagram showing a circuit configuration example of a remote controller used in the second embodiment.

The remote controller 50 can, for example, as shown in FIG. 10B, be configured to be equipped with a power source 51, such as a battery; a microcomputer 52 incorporating a ROM storing an ID code in a nonvolatile manner; a transmitter 53 transmitting a rewriting command of a set code in the SW table and the like; a keypad (key input section) 54 including a plurality of operation keys (a setting starting key, a search mode key, an execution key, numeric keys, and the like) for inputting a command to the microcomputer 52; and an indicator 55, such as a liquid crystal panel (LCD), as the occasion demands.

When a change of a set mode is performed to the LED power source unit 12 by wireless communication with the remote controller 50 mentioned above in an already laid lighting system, a wireless signal reaches a plurality of LED power source units 12. If the change is desired to be performed only in one LED power source unit 12 at a pinpoint, a contrivance other than the configuration described above is needed.

For example, a configuration is conceivable that gives a peculiar ID code to each of the LED power source units 12 on the controlled side (hereinafter referred to as a target device), stores the ID code into the memory of the microcomputer 28 in the LED power source unit 12 or the receiver unit 30, and transmits the ID code of the target device (transferring destination ID) and a command code instructing a mode change and the like besides the ID code of the device (transferring source ID) from the remote controller 50 at the time of performing a change of the set mode.

Even if the lighting system is configured as described above, however, when the LED power source unit 12 does not have any transmission functions and an operator of the remote controller 50 does not grasp the ID code of the target device, a change of the set mode is not easy. Accordingly, the search mode key, for example, is provided in the keypad 54 of the remote controller 50, and when the search mode key is operated, the microcomputer 52 automatically transmits the ID codes of all of the target devices and a command code instructing LED lighting (or flickering) in order.

The operator then releases the search mode at the time point of the lighting of a desired LED (target device), and operates the keypad 54 to transmit the ID code of the target device displayed on the indicator 55 at that time and a command code instructing a mode change and the like. After that, when the operator operates the wireless switch 14 desired to be associated or transmits the ID code of the wireless switch 14 to the target device from the remote controller 50, then the microcomputer 28 of the LED power source unit 12 of the target device is configured to write (or overwrite) the received ID code in the SW table thereof. Hereby, even if the device identification code of the LED power source unit 12 as a target device desired to change the setting thereof is not known, the setting changing in an inside of the LED power source unit 12 (power source control device) can be performed by the remote controller 50 as the wireless signal transmitting device.

Figure 11:
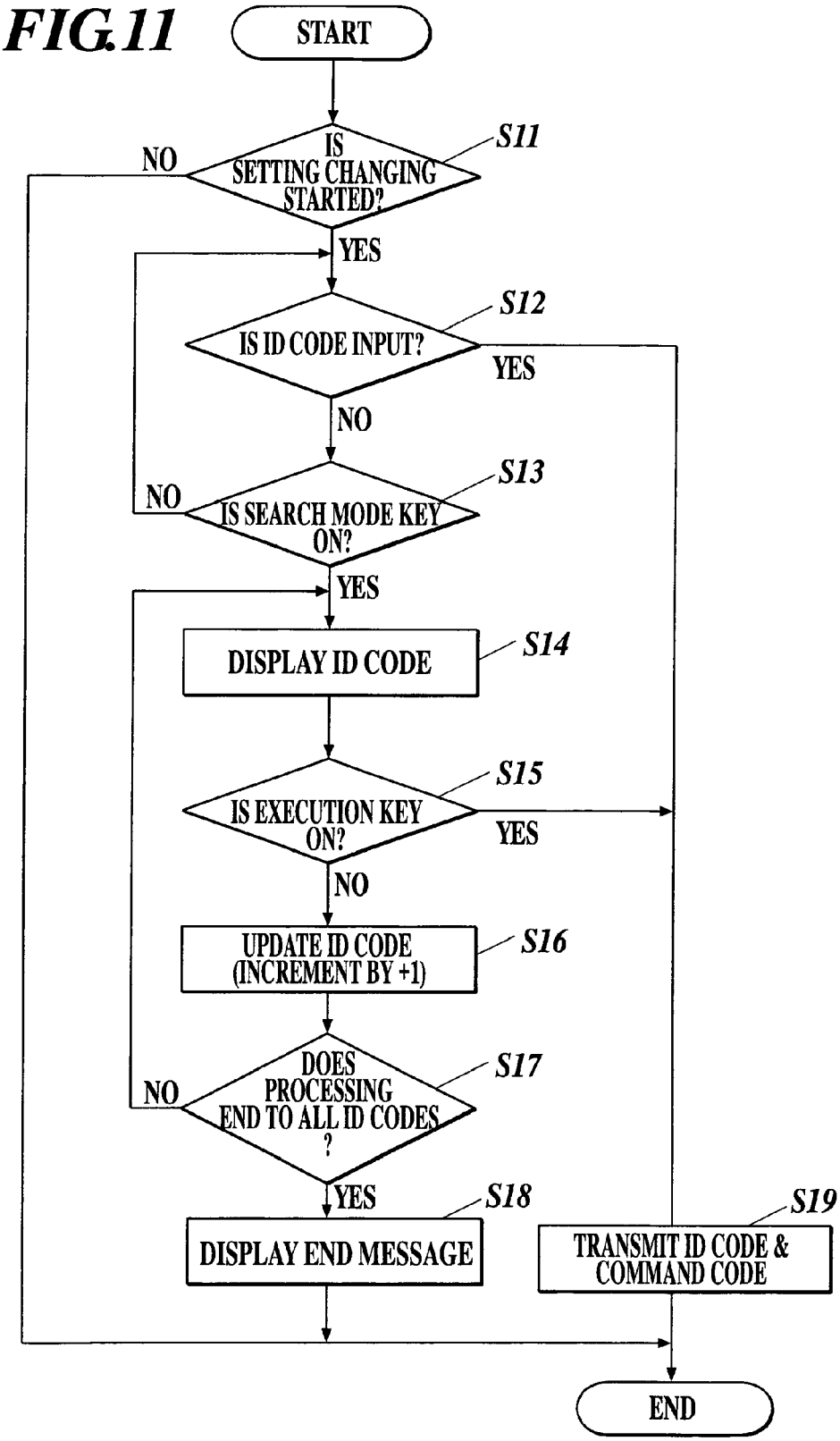
FIG. 11 is a flowchart showing an example of a process of the setting changing processing of a table of wireless switches by the remote controller in the second embodiment.
Figure 12A:
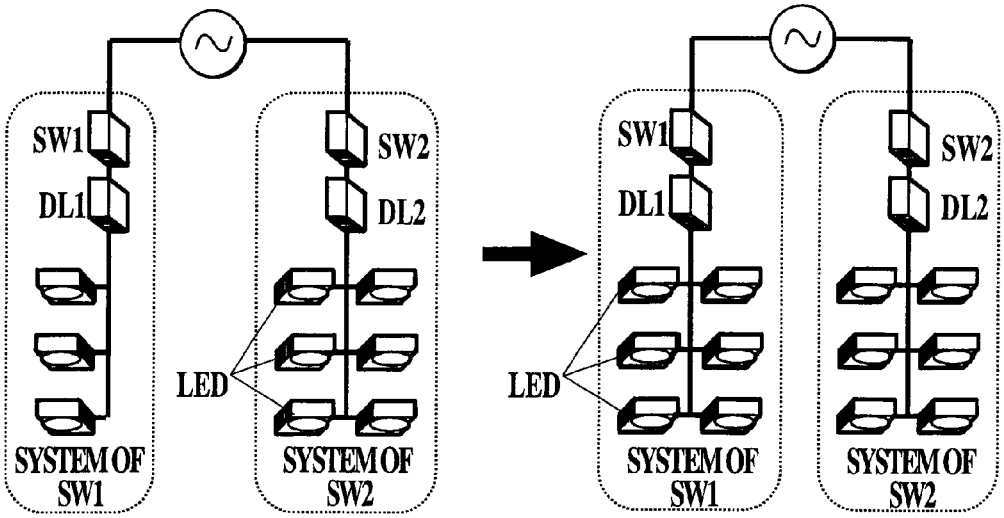
FIGS. 12A and 12B are explanatory diagrams showing methods of setting changes in a conventional lighting system.
Figure 12B:
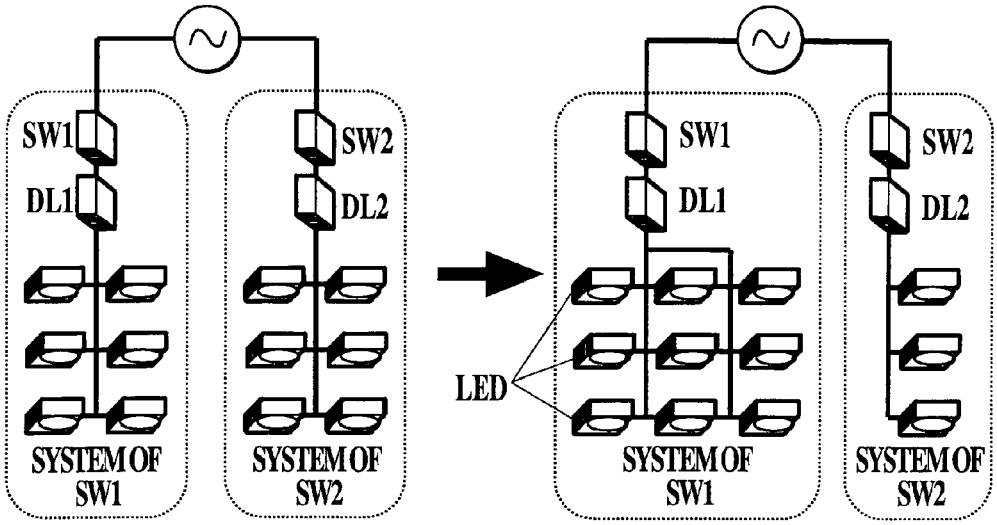
Figure 13:
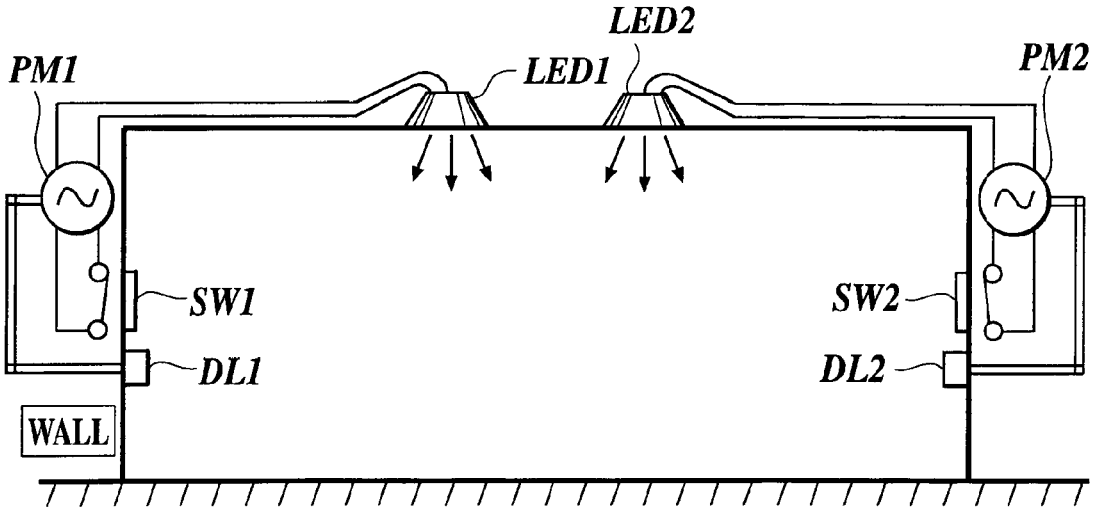
FIG. 13 is a schematic configuration diagram showing an example of the conventional lighting system.

FIG. 11 shows an example of a flowchart of the process of the setting changing processing of a table of the LED power source unit 12 with the remote controller 50. A control program in conformity with the flow chart is stored in the ROM of the microcomputer 52 of the remote controller 50, and is executed by the microcomputer 52. Thereby the setting changing processing of the table is executed.

As shown in FIG. 11, in the setting changing processing of the table, the setting changing key is first operated, and the microcomputer 52 judges whether the setting changing processing has been started or not (Step S11). When the microcomputer 52, then, judges that the setting changing processing has been started (Yes), the microcomputer 52 judges whether the ID code of a target device has been input with the numeric keys or not (Step S12). When the microcomputer 52 judges that the ID code has been input (Yes) here, the microcomputer 52 makes the processing jump to that at Step S19 to transmit the input ID code and a command code instructing lighting or flickering. In addition, when the microcomputer 52 judges that no ID codes have been input at Step S12 (No), the microcomputer 52 moves the processing to that at Step S13, and judges whether the search mode key has been operated or not. When the microcomputer 52 judges that the search mode key has not been operated (No) here, the microcomputer 52 returns the processing to that at Step S12.

On the other hand, when the microcomputer 52 judges that the search mode key has been operated at Step S13 (Yes), the microcomputer 52 moves the processing to that at Step S14 to display a first ID code on the indicator 55 of the remote controller 50. The microcomputer 52, next, judges whether the execution key has been operated or not (Step S15). When the execution key is not operated here, the microcomputer 52 updates (increments by 1) the ID code displayed at Step S14 (Step S16). The microcomputer 52, next, judges whether the display of all the ID codes has ended or not (Step S17). When the microcomputer 52 judges that the display of not all the ID codes has ended, the microcomputer 52 returns the processing to that at Step S14 to display the updated ID code on the indicator 55.

In addition, when the microcomputer 52 judges that the execution key has been operated at Step S15, the microcomputer 52 moves the processing to that at Step S19, where the microcomputer 52 transmits the displayed ID code and a command code instructing lighting or flickering and ends the setting changing processing of the table. On the other hand, when the microcomputer 52 judges that the display of all the ID codes has ended at Step S17 (Yes), the microcomputer 52 moves the processing to that at Step S18 to display an end message and ends the setting changing processing of the table. The process shown in FIG. 11 is only one example, and the setting changing processing of a table is not limited to that shown in FIG. 11, and the processing process changes depending on the functions of the keys provided on the keypad 54 of the remote controller 50.

Although the invention made by the inventors has concretely been described hereinbefore on the basis of the embodiments, the present invention is not limited to the embodiments described above. For example, although the LED power source unit 12 constituting each of the lighting systems of the embodiments has been shown as the one configured to have only the function of receiving the wireless signal from the wireless switch 14, the LED power source unit 12 can be configured to incorporate a transmitter therein to be able to perform bidirectional communication.

In addition, although the LED power source unit 12 of the first embodiment is shown (see FIG. 2) to be provided with the setting switch 29 on the surface of the main body case of the LED power source unit 12, the LED power source unit 12 can be configured to be provided with a light receiving element capable of sensing a light of a predetermined wavelength in place of the setting switch 29, and the lighting system can also be configured in order that a change of a set mode can be performed by an operation of the remote controller 50 in the state in which the LED power source unit 12 of a setting object is specified by radiating a light beam to the light receiving element.

Furthermore, although the embodiments described above are each shown to configure the wireless switch 14 and the remote controller 50 as separate wireless signal transmitting devices, the wireless switch 14 and the remote controller 50 can be configured as an integrated device. In addition, the wireless switch 14 is not limited to the energy self-feeding type one, but a wireless switch operated by a battery (small-sized battery) can be used.

The present invention has hereinbefore been described to be applied to an LED lighting system, which is a background of the present invention and is one of the application fields of the invention, but the application fields of the present invention are not limited to that LED lighting system. It is a matter of course that the present invention can be applied to a lighting system using illuminators other than the LED lamps, and furthermore the invention can be applied to a sound system or a voice guiding system using a plurality of installed speakers, a fragrance emitting system including a plurality of installed fragrance emitting devices capable of emitting various fragrances, a fire alarm, an air conditioner, an electric blind, a security door, and the like.

According to the embodiment mentioned above, the wireless signal transmitting device (wireless switch) to respond can be changed by changing the device identification code (ID code) held in the setting table in the power source control device (LED power source unit), and consequently an increase and a change of an illuminator (LED lamp) can comparatively easily be performed. The illuminance of the "illuminator" includes an illuminance "0," i.e. an extinction (OFF).

The changing way of the illuminance of the illuminator to be controlled can, hereby, be set freely in each wireless signal transmitting device (wireless switch).

The power source control device (LED power source unit) can, hereby, perform a corresponding control and a corresponding operation by automatically distinguishing between a signal from a wireless signal transmitting device (wireless switch) to be used for an ordinary lighting control and a signal from a wireless signal transmitting device (remote controller) to be used for a change of the setting table.

According to the embodiment described above, no batteries are needed to be incorporated in the wireless signal transmitting device (wireless switch), and consequently the disadvantages caused by a flat battery can be avoided.

The configuration of isolating the wireless signal transmitting device (wireless switch) used for an ordinary lighting control and the wireless signal transmitting device (remote controller) used for changing a setting table as separate devices enables the simplification of the wireless signal transmitting devices (wireless switches) for lighting controls, which are required to be provided in large numbers, and the decrease of the total system cost thereof.

According to the embodiment described above, even if the device identification code of the power source control device (LED power source unit) to be desired to change the setting thereof is not known, the setting changing of the inside of the desired power source control device can be performed with the wireless signal transmitting device (remote controller).

As described above, according to the embodiment of the present invention, the advantage of being capable of increasing and changing illuminators comparatively simply is obtained in a lighting system equipped with the plurality of illuminators and configured to be capable of being subjected to a dimming control.

The entire disclosure of Japanese Patent Application No. 2010-119028 filed on May 25, 2010 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A power source control device for controlling an illuminance of an illuminator by outputting a current for driving the illuminator and by controlling the current, comprising:

a receiver for receiving a wireless signal having a predetermined frequency;

a rewritable storage section for storing a setting table holding a first code indicating a predetermined device identification code;

a control signal generating circuit for comparing a second code included in the wireless signal received by the receiver with the first code held in the setting table to output a control signal when the second code agrees with the first code; and a current outputting circuit for generating and outputting a current according to the control signal from the control signal generating circuit, wherein the power source control device is configured to control the illuminance of the illuminator according to the wireless signal from a desired wireless signal transmitting device by setting a device identification code of the desired wireless signal transmitting device as the first code in the setting table.

2. The power source control device according to claim 1, wherein the setting table is configured to be able to hold a plurality of the first codes to control the illuminance of the illuminator according to wireless signals from a plurality of the wireless signal transmitting devices corresponding to the first codes held in the setting table, respectively.

3. The power source control device according to claim 2, wherein the setting table is configured to be able to hold a plurality of third codes each indicating function code specifying how to change the current to be output by the current outputting circuit correspondingly to each of the plurality of first codes, and the control signal generating circuit is configured to output the control signal corresponding to one of the third codes held in the setting table correspondingly to a first code agreeing with the second code included in the wireless signal received by the receiver.

4. The power source control device according to claim 1, wherein the setting table is configured to be able to hold a third code indicating a function code specifying how to change the current to be output by the current outputting circuit besides the first code, and the control signal generating circuit is configured to compare the second code included in the wireless signal received by the receiver with the first code held in the setting table to output a control signal corresponding to the third code held in the setting table when the second code agrees with the first code.

5. A lighting system, comprising:

the power source control device according to claim 4;

an illuminator driven to be lighted by the power source control device; and a wireless signal transmitting device including a switch button and an energy self-feeding device converting an operating force of the switch button into electric energy, wherein the wireless signal transmitting device is configured to include a storage section to store its own device identification code as the second code, and a transmitter capable of transmitting a wireless signal of a predetermined frequency, and to transmit the wireless signal including the second code when the switch button is operated.

6. The lighting system according to claim 5, further comprising:

a second function wireless signal transmitting device including a key input section, a storage section to store its own device identification code as the second code and a function code instructing to rewrite the setting table as the third code, and a transmitter capable of transmitting a wireless signal of a predetermined frequency, wherein the second function wireless signal transmitting device is configured to transmit a wireless signal including the second code and the third code when the key input section is operated.

7. The lighting system according to claim 6, wherein the second function wireless signal transmitting device is configured to be able to transmit a wireless signal including the second code indicating a device identification code specifying a power source control device to operate in response to the third code included in the wireless signal transmitted by the transmitter.

8. A lighting system, comprising:

the power source control device according to claim 4;

an illuminator driven to be lighted by the power source control device; and a wireless signal transmitting device including an input section, a storage section, a transmitter capable of transmitting a wireless signal of a predetermined frequency, and a control section to operate in conformity with a program stored in the storage section and control the transmitter according to an input from the input section, wherein the control section is configured to include a device identification code generating function of sequentially generating the second code indicating a device identification code given to each power source control device and a transmission function of making the transmitter transmit the generated second codes and a command code for instructing lighting or flickering.

9. The power source control device according to claim 1, wherein the first code includes a first device identification code for identifying a wireless signal transmitting device having a first function and a second device identification code for identifying a wireless signal transmitting device having a second function, and the control signal generating circuit compares the second code included in the wireless signal received by the receiver with the first code held in the setting table to cause the rewritable storage section to be shifted to a state where the first code held in the setting table to be rewritable when the second code agrees with the second device identification code.

* * * * *